US007374317B2

(12) United States Patent
Prazoff

(10) Patent No.: US 7,374,317 B2
(45) Date of Patent: May 20, 2008

(54) EXTERIOR WALL LAMPS

(76) Inventor: Michael Prazoff, 3495 Du Musee #303, Montreal, Que (CA) H3G 3C7

( * ) Notice: Subject to any disclaimer, the term of this patent is extended or adjusted under 35 U.S.C. 154(b) by 0 days.

(21) Appl. No.: 11/423,052

(22) Filed: Jun. 8, 2006

(65) Prior Publication Data

US 2007/0285929 A1 Dec. 13, 2007

(51) Int. Cl.
*F21S 10/00* (2006.01)

(52) U.S. Cl. ..... 362/382; 362/145; 362/257; 362/395; 362/410; 174/67

(58) Field of Classification Search ..... 362/382, 362/145, 147, 257, 362, 395, 410; 439/373, 439/535, 536; 174/66, 67
See application file for complete search history.

(56) References Cited

U.S. PATENT DOCUMENTS 3,188,379 A 6/1965 Simon
4,266,266 A 5/1981 Sanner
4,275,435 A * 6/1981 Dorn ..... 362/368
4,713,734 A 12/1987 DeKay
4,816,969 A 3/1989 Miller
5,213,412 A * 5/1993 Ciallella ..... 362/398
5,219,446 A * 6/1993 Klepac ..... 362/154
5,359,506 A * 10/1994 Koleno ..... 362/248
6,863,251 B1 * 3/2005 Gretz ..... 248/156
6,871,985 B2 3/2005 Humphrey
6,883,927 B2 * 4/2005 Cunningham et al. ..... 362/95
7,174,994 B1 * 2/2007 Coffield et al. ..... 182/129
2004/0085759 A1 * 5/2004 Kempf ..... 362/145
2004/0221883 A1 * 11/2004 Nipke ..... 135/16
2006/0231282 A1 * 10/2006 Greenfield ..... 174/67

* cited by examiner

*Primary Examiner*—Ali Alavi
*Assistant Examiner*—Evan Dzierzynski
(74) *Attorney, Agent, or Firm*—Cook, Alex, McFarron, Manzo, Cummings & Mehler, Ltd.; Edward D. Manzo

(57) ABSTRACT

An exterior light fixture includes a housing configured to be mounted to an exterior vertical wall. A luminaire is connected via a projecting arm to the housing and powered by electrical wires running therethrough. The housing includes a rotatable door which, when rotated from a closed position to an open position, exposes a ground fault interrupter circuit providing preferably three-pronged sockets to deliver grounded, protected AC current for consumer use.

8 Claims, 3 Drawing Sheets

EXTERIOR WALL LAMPS

BACKGROUND OF THE INVENTION

The present invention relates to wall lamps, especially exterior wall lamps.

There are various categories of lighting apparatus. One broad division of these apparatus is interior versus exterior lighting. A second broad division concerns the voltage used in such lamps, e.g. lamps which are powered by standard alternating current which in the United States is typically 120 volts AC versus low-voltage or direct-current lighting. The present invention concerns lighting which is powered by standard voltage, alternating current supply It is known to combine a lighting fixture with an electrical outlet. Thus, Miller U.S. Pat. No. 4,816,969 shows a wall mounted lighting fixture adapted to be placed over a bed, such as in a hospital for example, and includes electrical sockets 17 on a side face thereof. This does not, however, solve the problem of providing a convenient source of lighting on exterior surfaces of edifices such as homes, stores, restaurants and the like.

Humphrey U.S. Pat. No. 6,871,985 discloses a post lamp for outdoor lighting. This is not, however, a permanent fixture and is not a wall fixture nor any other kind of permanently-mounted fixture. Instead, it is portable and requires its own electric wire to extend to a power source. At the top of the pole is a luminaire, and at the base of the pole is an electric socket.

DeKay U.S. Pat. No. 4,713,734 discloses an interior wall lamp assembly having an elongated hollow conduit carrying and concealing electric current-carrying wires connected at the bottom end of the hollow conduit to an AC plug so that the device can be plugged into a wall socket. The device includes adhesives or Velcro fasteners to adhere the elongated member to a vertical wall. A projecting arm extends from the top of the elongated conduit to a lamp socket or the like. DeKay shows an auxiliary electric socket 11 mounted along a side wall of the elongated hollow conduit, Simon U.S. Pat. No. 3,188,379 illustrates a weatherproof electrical installation with a pivotally-attached hood apparatus. This, however, provides no lighting function and is, by definition, not a wall lamp. An alternative arrangement for protecting electric sockets in outdoor use is Sanner U.S. Pat. No. 4,266,266 which, like Simon, is not a light source but rather an outdoor electric socket fixture having downward facing sockets.

None of these patents, however, provides an exterior wall lamp which also provides a source of protected AC current for other uses. None of these solves the problem of needing access, around the outside of a house or other building, to standard AC power without adding extra, separate fixtures dedicated thereto.

An object of the present invention is to increase the utility of an exterior wall lamp fixture to provide a source of AC power for other applications and, preferably, while preserving esthetic features of the fixture.

SUMMARY OF THE INVENTION

The present invention provides a lamp fixture for mounting to a wall, preferably an exterior wall. The lamp fixture includes a housing member and a luminaire extending directly from the housing or connected thereto by another structure such as a projecting arm. The housing includes an electrical outlet of the type designed to connect to two-or-three prong AC plugs. Preferably the electric outlet is a ground fault interrupter type outlet. Preferably a movable door or hood covers the electric outlet. When the outlet is not in use, preferably the door in the closed position preserves the profile of the housing.

BRIEF DESCRIPTION OF THE DRAWINGS

In describing the present invention reference is made to accompanying drawings wherein like reference numerals represent like parts and wherein.

DETAILED DESCRIPTION OF PREFERRED EMBODIMENTS

Figure 1:
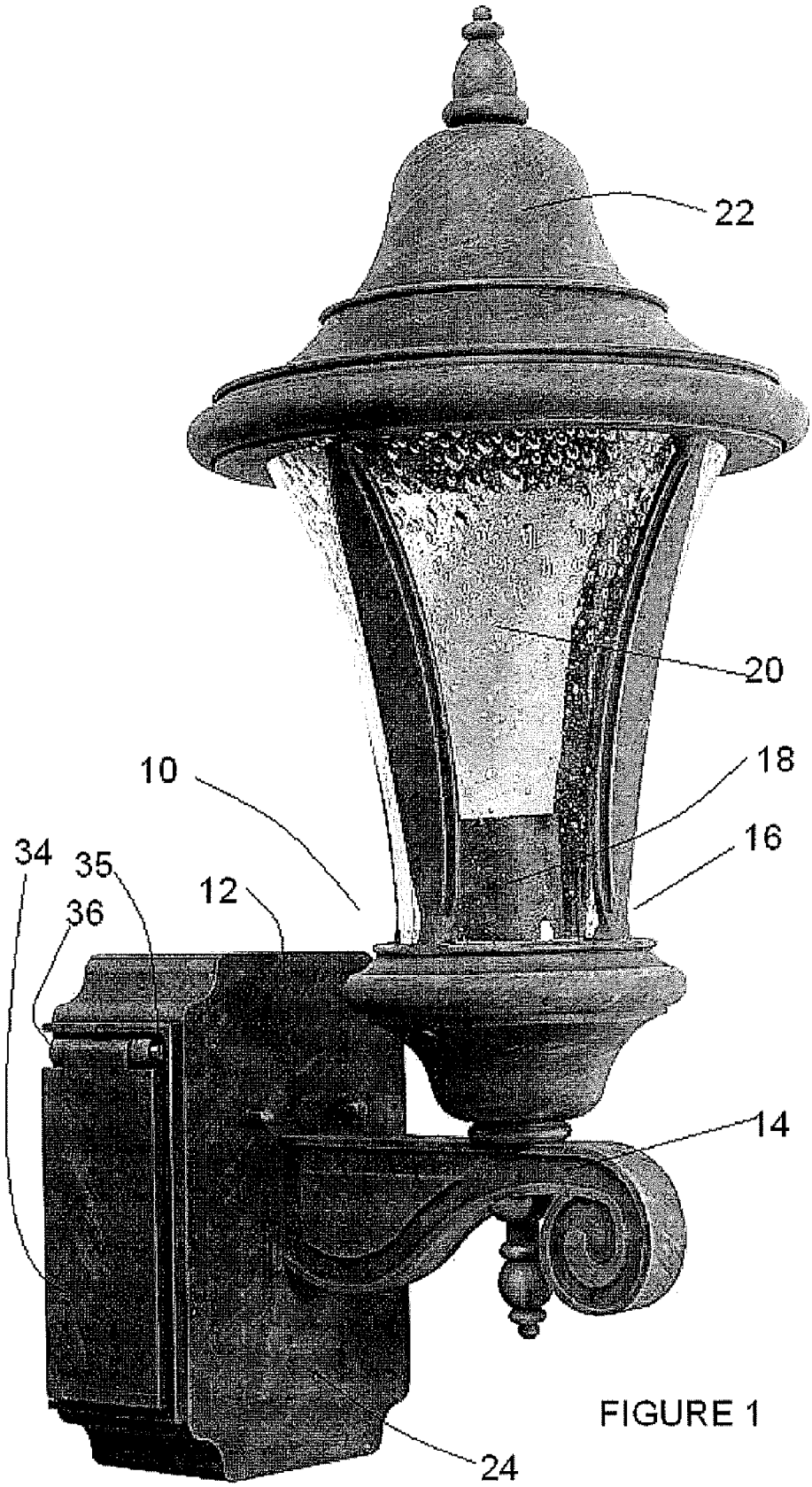
FIG. 1 is a perspective view of an exterior lamp fixture according to aspects of the present invention and showing the fixture with the door in a closed position.
Figure 2:
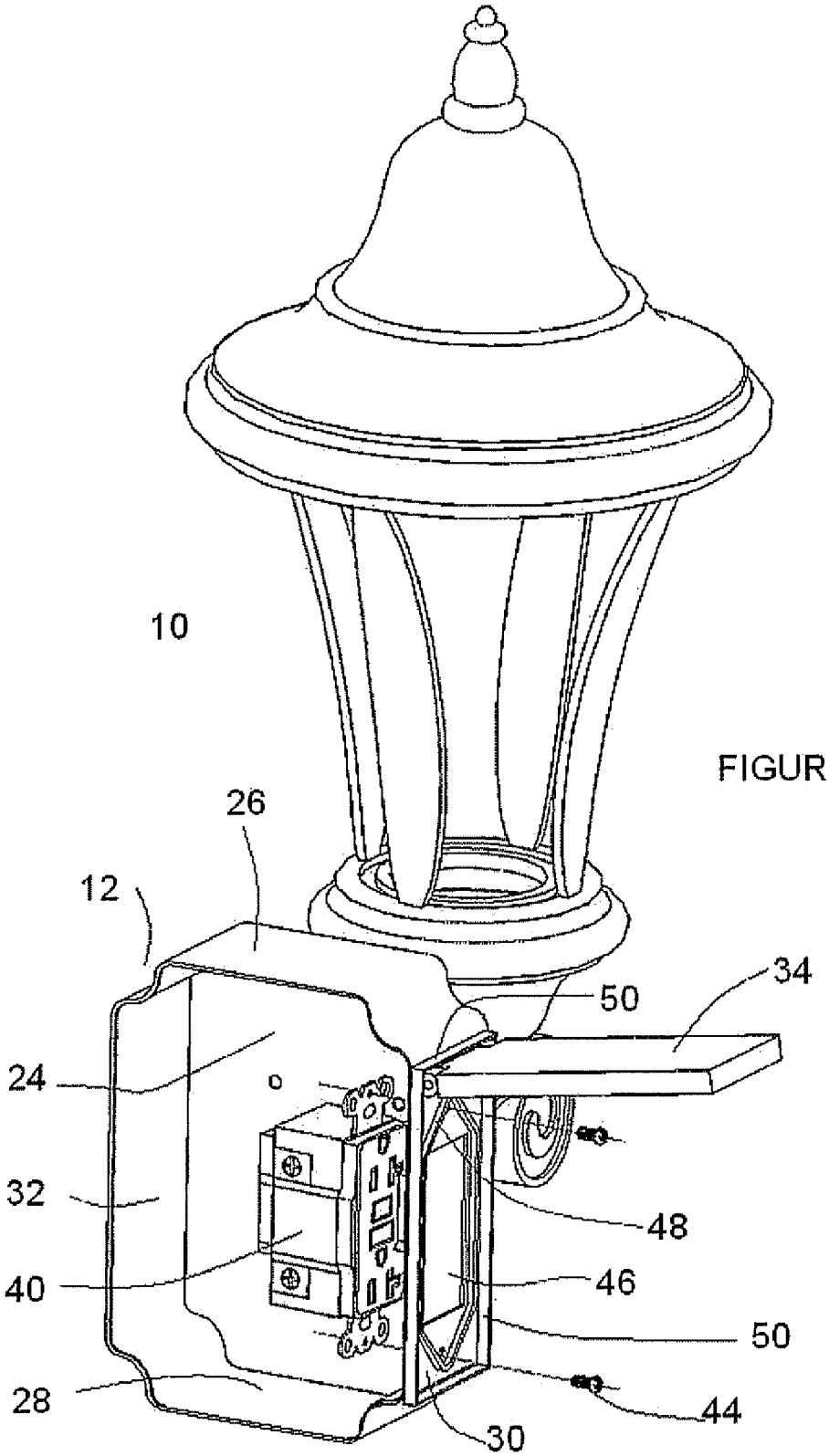
FIG. 2 is a rear perspective exploded view of a partially-assembled device of FIG. 1, but with the door in a partially open position.
Figure 3:
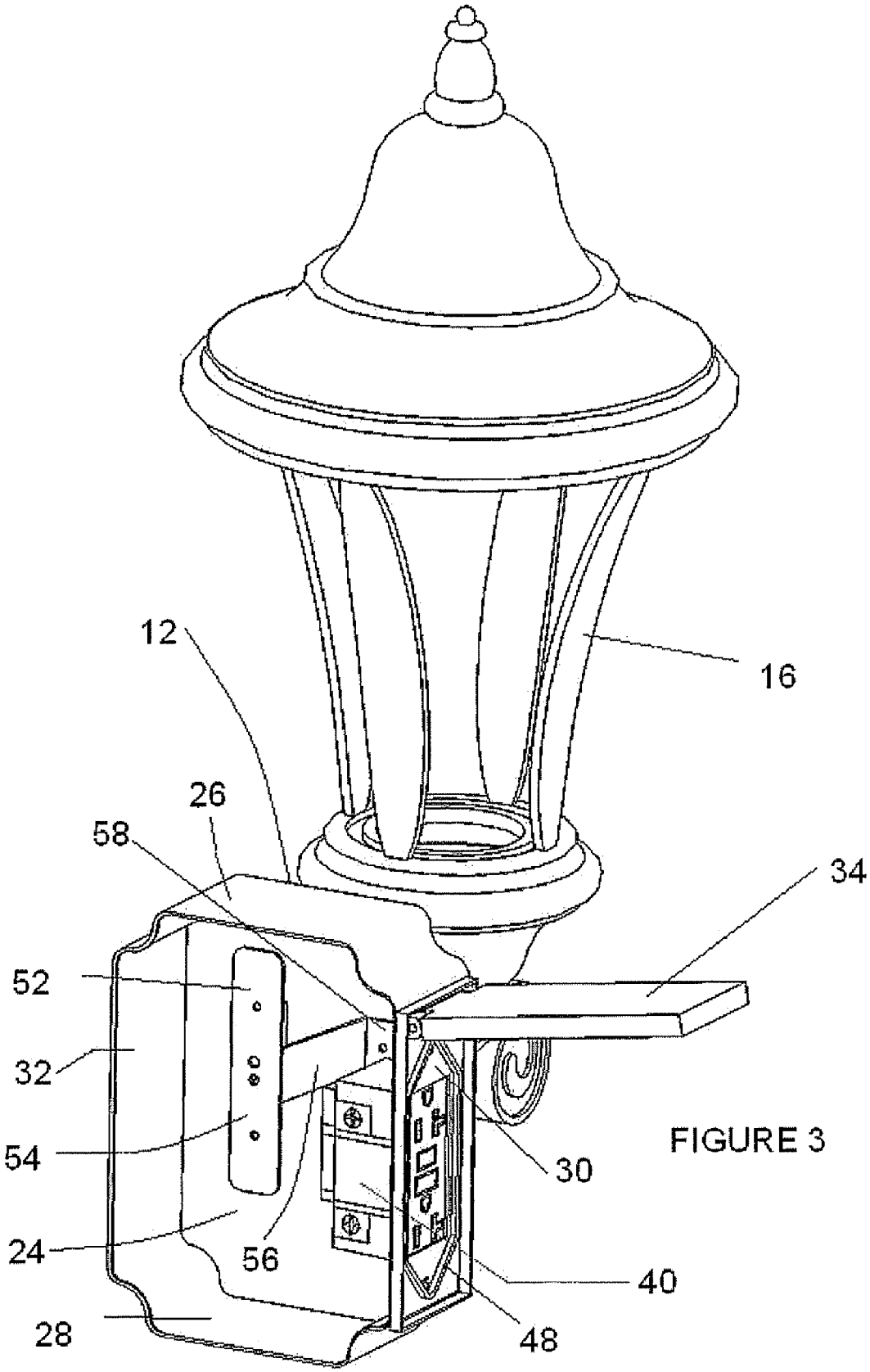
FIG. 3 is a rear perspective view of the assembled device of FIG. 1 (without showing a rear cover plate).

FIGS. 1 through 3 depict an exterior wall lamp embodying various aspects of the present invention. Fixture 10 includes a housing 12 configured to be connected along a vertical wall, typically an exterior wall. Projecting from the housing 12 is a projecting arm 14, and extending upward from arm 14 is a luminaire 16. It will be understood that the particular shapes, configuration, and ornamentation are not confined to the illustrative embodiment shown in the figures As is commonly known, there are various ornamentations and embellishments for lighting products which may be configured to present contemporary, modern, classic, neo-classic, Rococo, colonial, Early American, and numerous other architectural appearances. The structures are typically made of a cast metal although synthetic products are also used. The present invention includes all such architectural appearances and shapes and is not limited to the specific material from which the structure is made.

Fixture 10 is typically mounted to an electrical box or other fitting at an elevated location on an exterior wall. The manner of connection is well established in the art, and like fixture 10 uses the standard connections and fittings Accordingly, it will be understood that like fixture 10 is ordinarily connected to a source of single phase alternating current, typically 120 volts, or such other standard electrical power provided to residences in the United States and other countries. Wires (not illustrated) located within housing 12 connect to the wires available within the wall structure to which fixture 10 is being connected. The internal wires within fixture 10 extend through a cavity in projecting arm 14 and connect electrically in standard manner to one or more light sockets 18 within luminaire 16. The socket or sockets 18 receive one or more lamps and, when power is turned on through a switch, which is typically located at an inside location available to the user, create light which radiates through a globe 20 typically made of glass or plastic and providing illumination for the area surrounding fixture 10. Typically a protective roof or dome 22 is provided above the one or more lamps to protect them from inclement weather. Various mechanical components are included in the light fixture 10 as customary in the industry and well-known to the art.

FIGS. 1 and 2 show that projecting arm 14 extends generally perpendicularly from a central location of a front wall 24 of housing 12. Face 24 is typically but not necessarily a flat member In addition to front wall 24, housing 12 includes top and bottom walls 26, 28 and side walls 30 and 32.

In the illustrated embodiment, a door or hood 34 is movable with respect to housing 12. In the illustrated embodiment, door 34 is a generally rectangular structure engaging an axle member 35 extending horizontally within bearings 36 located at the top of door 34. These constitute an illustrative pivoting arrangement. Hence, door 34 is connected to articulate with respect to the rest of housing 12. It will be appreciated that the axle and bearing arrangement 35, 36 may include further or alternative structure to maintain door 34 in a non-vertical position through a friction fit or, alternatively, may allow door 34 to articulate completely freely so that after being lifted up by a user, it falls to its rest position through the force of gravity. The rest position is shown in FIG. 1 wherein door 34 is vertical and parallel to its adjacent wall 30, thus giving the appearance from a front view of a housing for an exterior wall lamp.

FIG. 2 is a rear perspective partially-exploded view of most of the structure of device 10. It illustrates fixture 10 where door 34 is in a partially opened position. Moving door 34 in this fashion exposes the front face of an electric socket 40. Preferably socket 40 is configured to receive a three-prong AC plug. More preferably, electrical socket 40 is adapted to receive up to two standard three-prong AC connectors in a vertical configuration where one socket is located vertically above the other socket. Preferably the socket 40 is a ground fault interrupter (GFCI) of standard construction. Electrical socket 40 is connected to the side wall 30 by screws 44. The interior electrical wiring of housing 10 is arranged to provide AC power to not only the luminaire 16 but also to the electrical socket 40.

Still referring to FIG. 2, the front of electrical socket 40 fits into an aperture 46 in side wall 30. Illustratively, a ridge 48 projects outward laterally from side wall 30 and circumscribes aperture 46. Ridge 48 need not be rectangular (the shape of aperture 46) but can have other shapes. In the illustrated embodiment, ridge 48 forms a six-sided closed polygon with the two vertical portions being longer than the other four portions of this polygon. Thus, it will be seen in FIGS. 2 and 3 that ridge 48 has substantially vertical portions that flank and are parallel to the side, vertical edges of aperture 46. Ridge 48 also includes four additional portions, two of them extending above the top of aperture 46, and two of them extending below the bottom of aperture 46. Illustratively, the ridge extends beyond apertures that receive screws 44 (which are used to secure electrical socket 40 to housing 12.

Laterally outward from ridge 48 is a frame 50 which extends outwardly from sidewall 30 and illustratively is rectangular in shape to correspond to the overall shape of door 34. Thus, the ridge 48 is within a region defined by frame 50. Preferably frame 50 is integral with housing 12 and extends laterally therefrom. Preferably the forward portion of frame 50 is at or near the front wall 24 of housing 12. For aesthetic purposes, it may be slightly rearward thereof. Preferably the rear vertical portion of frame 50 is aligned or slightly offset from the rear of housing 12. As shown in the figures, frame 50 is slightly larger than door 34, and the axle 34 and bearings 36 are located laterally and vertically within the space defined by frame 50. However, axle 35 and bearings 36 may extend further laterally away from sidewall 30 than frame 50 extends, as seen in the figures. It will be seen also that the axle 35 and bearings 36 are generally located at the top portion of frame 50.

Door 34 may comprise a member of substantially constant thickness or may itself have perimeter walls which extend further back toward housing 12 to form a cavity behind the front face of door 34. Preferably door 34 is a single, integral member. Preferably the door 34 is generally rectangular in shape and fits within frame 50. Illustratively but not necessarily the front face of door 34 may be located further laterally away from housing 12 than the outermost edges of frame 50. A benefit of this is that a user can grasp the bottom of door 34 more easily when it projects laterally outward beyond frame 50. In one embodiment, the door 34 in the closed position is parallel to side wall 30 and comes to rest upon the outside of ridge 48 which may be used to form a seal. Alternatively, when door 34 is in the closed position, it need not touch any portion of ridge 48.

Referring to FIG. 3, the electrical socket 40 is shown connected to side wall 30, and a bracket 52 is provided for mechanical connection of the housing 12 to the exterior wall or to a rear wall (not illustrated) of housing 12. Illustratively, bracket 52 includes a rear, vertically extending portion 54 connected to a transverse portion 56 which connects to a front member 58. Preferably member 58 is attached to the rear face of front wall 24.

A rear wall for housing 12 may be included and may connect to housing 12 via screws or other fasteners associated with rear vertical member 54 or otherwise. Alternatively, the rear vertical member 54 may be connected directly to the exterior wall.

In use, after fixture 10 has been installed on a wall, it is usable to provide illumination as is customary but it provides the further versatility of being a source of power for electrical devices. Illustratively, such devices could be a power tool, an extension cord for seasonal lighting or other purposes, lawn maintenance equipment or the like, or numerous other apparatus calling for AC power. The electrical socket 40 is convenient and secure when the ground fault interrupter circuit is used.

The invention claimed is:

1. A light fixture for mounting to an electric box or other electrical fitting associated with a vertical exterior wall of a building, the electric box or other electrical filling providing electric power, the light fixture comprising:

a generally rectangular housing having a front wall, top and bottom walls, and first and second opposite side walls, the housing being fixedly fastenable to the vertical exterior wall or electric box or other electrical fitting associated with the vertical exterior wall, so that a rear portion of the housing is adjacent to said exterior wall when so mounted;

wherein the first side wall includes an aperture;

a ground fault interrupter circuit located within the housing and presenting an electrical socket accessible via said aperture;

a frame extending laterally outward from said first side wall, the frame generally extending around borders of the first side wall and having approximately the same size as the wall;

a door movably connected to said housing to permit movement between a closed position and an open position, wherein said door in said closed position covers said aperture, said electrical socket, and a substantial portion of the first side wall, and wherein the door, when in its closed position, is located substantially within the frame, wherein the door has a major surface having a shape and size generally corresponding to the shape and size of the second side wall so that when the door is in the closed position, the major surface of the door presents generally the same size and appearance as the second side wall but in the opposite location relative to the housing, wherein the door in said open position permits access to said electrical socket; and a luminaire connected to and extending from the front wall of said housing.

2. The light fixture of claim 1 and further comprising:

a raised ridge extending laterally outward from said first side wall, the raised ridge being located between the door and the side wall and being located to be covered by the door when the door is in its closed position, the raised ridge extending completely around the aperture, the door when in its open position exposing the aperture and the raised ridge.

3. The light fixture of claim 1:

wherein said movable door is dimensioned to extend in location from substantially the front wall of said housing to the rear of said housing.

4. The light fixture of claim 1:

wherein said door occupies a major portion of the area of the first side wall.

5. The light fixture of claim 4:

wherein the first side wall having the aperture further includes a raised ridge extending laterally outwardly therefrom, the raised ridge being located between the door and the first side wall and being located to be covered by the door when the door is in its closed position, the raised ridge extending completely around the aperture, the door when in its open position exposing the aperture and the raised ridge; and wherein the movable door is dimensioned to extend from substantially the front wall of the housing toward the rear portion of the housing.

6. The light fixture of claim 1 further comprising a pin and mounting structure for rotationally engaging the door, wherein the pin is horizontally oriented when the light fixture is mounted on the vertical exterior wall, and wherein the pin and mounting structure are located within an area defined by the frame.

7. A light fixture for mounting to an electric box or other electrical fitting associated with a vertical exterior wall of a building, the electric box or other electrical fitting providing electric power, the light fixture comprising:

a housing having a front wall with a top to bottom dimension approximately equal to a side to side dimension, top and bottom walls smaller in area than the front wall, and first and second opposite side walls smaller in area than the front wall, the housing being fixedly fastenable to the vertical exterior wall or electric box or other electrical fitting associated with the vertical exterior wall, so that a rear portion of the housing is adjacent to said exterior wall when so mounted;

a frame extending laterally outward from said first side wall, the frame generally extending around borders of the first side wall, the frame extending from substantially the front wall of the housing to the rear of the housing;

a door rotationally connected to said housing to permit movement between a closed position and an open position, the size of the door being smaller than inside dimensions of the frame;

wherein the frame is slightly larger than, and extends around, the door;

wherein the first side wall includes an aperture;

a ground fault interrupter circuit located within the housing and presenting an electrical socket accessible via said aperture;

wherein said door in said closed position covers said aperture, said electrical socket, and a substantial portion of the first side wall, and wherein the door, when in its closed position, is located substantially within the frame, wherein the door has a major surface having a shape and size generally corresponding to the shape and size of the second side wall so that when the door is in the closed position, the major surface of the door presents generally the same size and appearance as the second side wall but in the opposite location relative to the housing, wherein the door in said open position permits access to said electrical socket; and a luminaire connected to and extending from the front wall of said housing.

8. The light fixture of claim 7 further comprising a pin and mounting structure for rotationally engaging the door, wherein the pin is horizontally oriented when the light fixture is mounted on the vertical exterior wall, and wherein the pin and mounting structure are located within an area defined by the frame.

* * * * *